US006124705A

United States Patent [19]

Kwong

[11] Patent Number: 6,124,705

[45] Date of Patent: Sep. 26, 2000

[54] CASCODE CURRENT MIRROR WITH AMPLIFIER

[75] Inventor: Pamela C. Kwong, Whitehall, Pa.

[73] Assignee: Lucent Technologies Inc., Murray Hill, N.J.

[21] Appl. No.: 09/377,851

[22] Filed: Aug. 20, 1999

[51] Int. Cl.[7] ..... G05F 3/16

[52] U.S. Cl. ..... 323/316

[58] Field of Search ..... 323/315, 316, 323/317, 364, 274

[56] References Cited

U.S. PATENT DOCUMENTS 4,849,684 7/1989 Sonntag et al. ..... 323/313
5,422,563 6/1995 Pflueger ..... 323/312

*Primary Examiner*—Shawn Riley

[57] ABSTRACT

A cascode current mirror for use as a biasing element or as a load device for amplifier stages in which the output resistance is increased so as to produce a substantially lower change in output current as supply voltages vary. The cascode current mirror incorporates an amplifier connected to provide negative feedback on the output cascode transistors in boosting the output resistance by a factor equal to the amplifier gain.

2 Claims, 1 Drawing Sheet

CASCODE CURRENT MIRROR WITH AMPLIFIER

BACKGROUND OF THE INVENTION

1. Field of the Invention

This invention relates to cascode current mirrors, in general, and to the microelectronic reproduction of a reference current for use in a binary-weighted current digital-to-analog converter, in particular.

2. Description of the Related Art

As is known, current sources are widely used in microelectronic circuitry as biasing elements and as load devices for various types of amplifier stages. As is also known, such use of current sources in biasing arrangements prove advantageous in the superior insensitivity of circuit performance to power supply variations and to changes in temperature which are oftentimes present. When used as a load element in transistor amplifier stages, furthermore, the high incremental resistance exhibited by the current source leads to high voltage gains at low power supply voltages. Because of these characteristics, a desirable application for a current source is in the binary-weighted current digital-to-analog converter. In such uses, a cascode current source employing MOS field-effect transistors is commonly employed, offering an accurate reproduction of the reference current.

One of the most important aspects of current-source performance with these MOS transistors, however, is the variation of current which results in the cascode mirror due to drain-source voltage changes at the output terminal. As will be appreciated by those skilled in the art, this can be characterized by the small signal output resistance of the current source. When the MOS transistors are used in the cascode current source mode, its small signal output resistance is typically set forth as:

$$R_o=r_{o2}[1+(g_{m2}+g_{mb2})r_{o1}]+r_{o1}$$

Where $r_{o2}$ represents the output resistance of one of the MOS transistors in the output pair, $r_{o1}$ equals the output resistance of the other MOS transistor, $g_{m2}$ is the transconductance of the first transistor, and $g_{mb2}$ is the bulk transconductance of the first transistor. $R_o$, in such formulation, represents the small signal output resistance of the circuit.

In actual circuit operation, on the other hand, the output voltage can vary (i.e., anywhere from ground to the supply voltage), with the resultant change that the reproduced current will vary as well. Thus, it would be beneficial if the output resistance of the cascode current mirror could somehow be increased so that any change in the output voltage would result only in a very small change in the output current.

SUMMARY OF THE INVENTION

As will become clear from the following description, a new and improved cascode current mirror is provided, which employs an amplifier in a negative feedback mode so as to boost the output resistance of the cascode mirror. With the preferred embodiment set forth, in fact, the output resistance is improved by a factor of (1+A) as compared with the output resistance of the cascode current mirror itself—where A represents the gain of the amplifier stage. In this embodiment, as will become clear, three MOS field-effect transistors are employed—in thus boosting the accuracy of the output current even in the presence of power supply variations.

BRIEF DESCRIPTION OF THE DRAWING

These and other features of the present invention will be more clearly understood from a consideration of the following description, taken in connection with the accompanying drawing, in which.

DETAILED DESCRIPTION OF THE INVENTION

Figure 1:
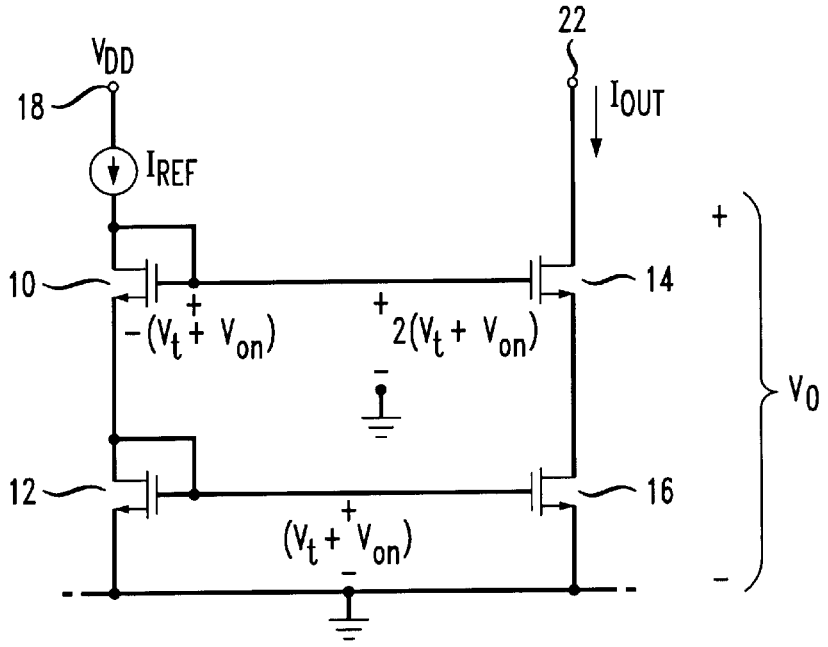
FIG. 1 PRIOR ART
FIG. 1 is a schematic diagram of an MOS cascode current source as commonly used in the prior art.

In the prior art construction of FIG. 1, four MOS transistors 10, 12, 14 and 16 are utilized. As shown, the source electrodes of transistors 12 and 16 are each connected to ground, while their respective gate electrodes are coupled together, as are the gate electrodes of the transistors 10, 14. The source electrode of transistor 10 is connected to the drain electrode of transistor 12, and to its gate electrode as well. The source electrode of transistor 14 is connected to the drain electrode of transistor 16—and the circuit is completed by connecting the drain electrode of transistor 10 to its gate electrode, with a voltage source 18 then applied to the drain electrode of transistor 10. As indicated in FIG. 1, a reference current $I_{ref}$ flows in the drain circuit of transistor 10, and is replicated in the drain circuit of the transistor 14 as $I_{out}$, at an output voltage designated as $V_o$. As will be appreciated by those skilled in the art, the output terminal 22 is coupled to the various other microelectronic circuits where the output current $I_{out}$ is to be used, such as in the digital-to-analog converter environment noted above. In such a configuration, the voltage developed at the joined gate electrodes of the transistors 12 and 16 is substantially equal to the sum of the threshold voltage that is needed to turn on the transistor ($V_t$) and the additional voltage ($V_{on}$) required to bias the transistor to the predetermined current desired. With this configuration, the voltage at the connected gate electrodes of the transistors 10 and 14 is essentially twice that amount— or, $2(V_t+V_{on})$. As understood, the sole purpose of transistor 10, in this arrangement, is to set up the fixed voltage for the cascode device. However, as noted previously, as the supply voltage at terminal 18 can vary, so can the output voltage $V_o$ and the output current $I_{out}$. This can deleteriously affect the capability of the cascode current source of FIG. 1 to operate effectively either as a biasing element or as a load for subsequent amplifier stages.

Figure 2:
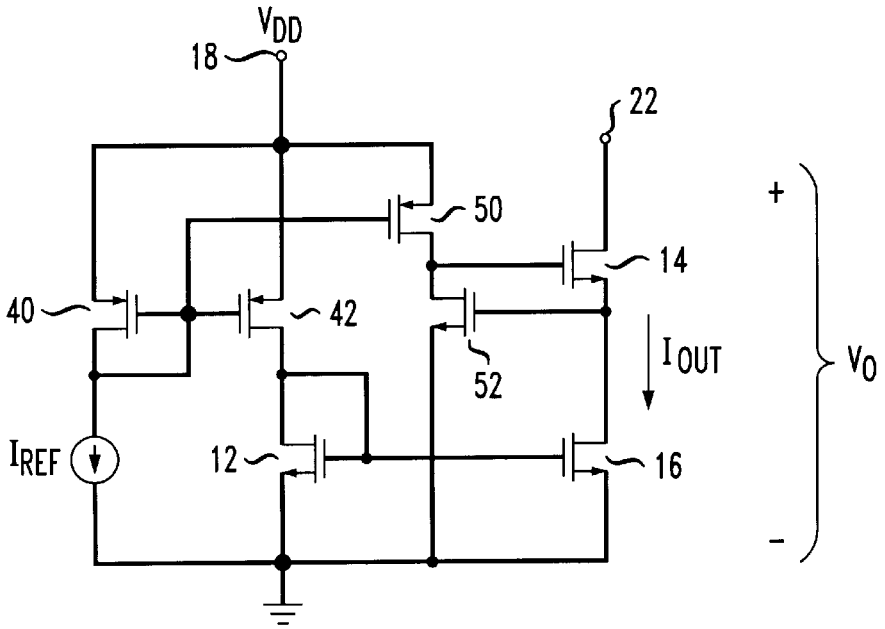
FIG. 2 is a schematic diagram of an MOS cascode current mirror using amplification as negative feedback in accordance with the invention.

In FIG. 2, the MOS transistors 12 and 16 are retained, with their source electrodes both going to ground, with their gate electrodes being connected together, with the drain electrode of the transistor 12 being connected to its gate electrode, and with the drain electrode of the transistor 16 continuing to be coupled to the source electrode of the transistor 14, in whose drain circuit the output current $I_{out}$ flows, at an output voltage $V_o$ at the terminal 22. The MOS transistor 10 of FIG. 1, whose source electrode was previously connected to the drain electrode of transistor 12 is eliminated, however, and replaced by a pair of further MOS transistors 40, 42—the gate electrodes of which are connected together, as are their source electrodes, which are in turn coupled to the power supply 18. With the drain electrode of the transistor 42 connected to the drain electrode of the transistor 12, and with the gate electrode of the transistor 40 connected to its drain electrode, a reference current flows in the drain circuit of the transistor 40, again denoted as $I_{ref}$.

To complete the cascode current mirror in accordance with the invention, two further MOS transistors 50, 52 are included, with the source electrode of the transistor 50 being coupled to the power supply 18, with its gate electrode connected to the joined gate electrodes of the transistors 40 and 42, and with its drain electrode connected to the gate electrode of transistor 14 and to the drain electrode of the transistor 52. The gate electrode of that transistor 52 is connected to the join of the source electrode of the transistor 14 with the drain electrode of the transistor 16, while the source electrode of the transistor 52 is connected to ground. As with the arrangement of FIG. 1, the output current $I_o$ flows through the transistors 14 and 16, at the output voltage $V_o$.

As will be appreciated by those skilled in the art, the connections of the transistors 50, 52 form an amplifier with negative feedback to, first of all, offset any output voltage changes tending to be produced at terminal 22. At the same time, it can be calculated that the output resistance is boosted by a factor of 1+A, where A represents the gain of the amplifier. In particular, this can be calculated from a realization of the following equations:

$$R_o = \frac{V_o}{I_o}$$

where $R_o$ equals the output resistance, $V_o$ is the output voltage and $I_o$ is the output current; and $$I_o = \frac{V_s}{r_{o1}}$$

where $V_s$ equals the voltage at the source electrode of transistor 14 and $r_{o1}$ equals the output resistance of transistor 16; and from $$I_o = \frac{g_m V_{gs} + V_o - V_s}{r_{o1}}$$

where $g_m$ is the transconductance of transistor 14 and $V_{gs}$ is the drain to source voltage across transistor 52. Solving for the output resistance $R_o$ results in the following equation:

$$R_o = r_{o2} + r_{o1} + r_{o1} r_{o2} g_m (1+A)$$

where $r_{o2}$ equals the output resistance of transistor 14 and "A" represents the amplification provided by the transistors 50 and 52. Since the output resistance $R_o$ between terminal 22 and ground thus is increased by the amplification factor, tendencies for the output voltage $V_o$ to vary produce less effect on changing the output current $I_o$, resulting in the replicated current being more stable and more constant than with the conventional cascode current source of FIG. 1. The output current thus becomes less responsive to voltage changes, and the cascode current mirror of the present invention thereby becomes more stable as a biasing element for other circuits in conjunction with which it might be used, or as a load device for following amplifier stages.

While there has been described what is considered to be preferred embodiment of the present invention, it will be readily appreciated by those skilled in the art that modifications can be made without departing from the scope of the teachings herein. For example, whereas the improved cascode current mirror of FIG. 2 is particularly attractive for use in a binary digital-to-analog converter, the increase in the accuracy of the output current which results also makes this cascode current mirror especially suited for use in the front-end of an operational amplifier, as well as for the charge pump of a phase detector in a phase-locked loop configuration. For at least such reason, therefore, resort should be had to the claims appended hereto for a true understanding of the scope of the invention.

I claim:

1. A cascode current mirror comprising:

first and second MOS field-effect transistors, each having source, drain and gate electrodes, with the source electrode of said first transistor connected with the drain electrode of said second transistor and through which an output current flows as a function of a reference current coupled to the gate electrodes of said first and second transistors;

and an amplifier providing negative feedback between said source electrode of said first transistor and said gate electrode of said first transistor;

with the gain of said amplifier being selected to increase an output resistance between the drain electrode of said first transistor and a point of reference voltage connected to said source electrode of said second transistor;

wherein said output resistance is increased by a factor of A, where A represents the gain provided by said amplifier; and wherein said amplifier includes a second pair of MOS field-effect transistors, each having source, drain and gate electrodes, in which said source electrode of one of said second pair of transistors and said source electrode of the other of said second pair of transistors are coupled between a source of supply voltage and said point of reference voltage, in which the drain electrodes of each of said second pair of transistors are connected together, wherein the gate electrode of said other of said second pair of transistors is connected to said source electrode of said first transistor, and in which said gate electrode of said one of said second pair of transistors is coupled to receive said reference current.

2. The cascode current source of claim 1, wherein said reference current is provided by a circuit including a further three MOS field-effect transistors, each having source, drain and gate electrodes, in which said source electrodes of the first and second transistors of said additional three transistors are connected to said source of supply voltage whereas said source electrode of said third transistor of said additional three transistors is coupled to said point of reference voltage, wherein said gate and drain electrodes of each of said first and third transistors of said additional three transistors are connected together, wherein said gate electrodes of said first and second transistors of said additional three transistors are connected together, wherein the gate electrode of said second transistor of said additional three transistors is connected to said gate electrode of said one transistor of said second pair of MOS field-effect transistors, and wherein said gate electrode of said third transistor of said additional three transistors is connected to said gate electrode of said second MOS field-effect transistor.

* * * * *